US005311705A

United States Patent [19]

Zuzelo

[11] Patent Number: 5,311,705

[45] Date of Patent: May 17, 1994

[54] CONTOURED CUTTING TOOL

[76] Inventor: Edward A. Zuzelo, 622 Broad Acres Rd., Narberth, Pa. 19072

[21] Appl. No.: 846,479

[22] Filed: Mar. 6, 1992

[51] Int. Cl.[5] ..... B24D 7/02

[52] U.S. Cl. ..... 51/206 R; 125/15; 51/209 R

[58] Field of Search ..... 51/204, 206 R, 206 P, 51/209 R; 125/12, 13.01, 15

[56] References Cited

U.S. PATENT DOCUMENTS

| | | | |
|---|---|---|---|
| 2,701,134 | 2/1955 | Klicpera | 262/20 |
| 3,301,601 | 1/1967 | Zuzelo | 299/39 |
| 4,188 934 | 2/1980 | Reinhardt et al. | 125/13 R |
| 4,267,814 | 5/1981 | Benson et al. | 51/206 R |
| 4,722,320 | 2/1988 | Delk, III | 51/206 R |
| 4,909,234 | 3/1990 | Matsuda | 125/15 |
| 5,040,341 | 8/1991 | Okinaga | 51/206 R |

*Primary Examiner*—Bruce M. Kisliuk
*Assistant Examiner*—Eileen P. Morgan
*Attorney, Agent, or Firm*—John W. Logan, Jr.

[57] ABSTRACT

A contoured cutting element for cutting a contoured groove, i.e. other than square or rectangular, in a substrate of plastic, metal, concrete, asphalt, macadam, stone or the like has a cutting surface whose length, in the direction of cutting of the element is directly proportional to the amount of material that portion of the cutting surface must remove to provide uniform wear on the cutting surface over long periods of usage.

12 Claims, 3 Drawing Sheets

CONTOURED CUTTING TOOL

FIELD OF INVENTION

This invention relates to contoured cutting or abrading tools for cutting contoured grooves or forming a contoured surface in material including metal, plastic, concrete, asphalt, stone and the like, and particularly to contoured cutting elements for such tools designed to wear uniformly so that the contoured shape of the cut material and tool does not change substantially over extended periods of use.

BACKGROUND OF THE INVENTION

Grooves have been cut in airport runways and road surfaces to facilitate water run-off and prevent hydroplaning. The typical airport runway groove is ¼ inch of an inch wide by ¼ of an inch deep. The usual spacing between grooves varies from ¾ of an inch or less to 4 inches or more. A major airport runway may thus have millions of linear feet of grooves cut into it. These grooves can be cut by a series of spaced rotating tools, each carrying cutting elements spaced about their periphery. The cutting elements have a rectangular cross-sectional shape corresponding to the desired dimensions of the final grooves. Because of the fact that each longitudinal segment of the cutting element cuts or abrades the same amount of material as the next adjacent segment, the cutting elements wear uniformly, thereby producing the desired shaped groove during their entire cutting life.

Square grooves, particularly in airport runways, have certain inherent disadvantages. They are difficult to keep clean; they are subject to having their edges chipped by snow plows; and, most important, particularly in asphalt runways, the grooves tend to close due to the impact of airplanes taking off, landing and braking. This necessitates a regrooving of the runway requiring extended periods of closing the runway.

In the early days of grooving runways, V-shaped grooves and trapezoidal grooves, wider at the top than at the bottom were found effective. They are easier to clean, resist damage by snowplows, and resist peening over or closing by landing aircraft. However, such grooves were soon abandoned because of the lack of the ability to produce such grooves of uniform configuration from one end of the runway to the other. To produce a V-shaped groove with the cutting tool rotating about a horizontal axis, the cutting elements must also be V-shaped. In cutting with such a tool, the tip of the V or the apex cuts a quantity of material equal to the depth of the groove, while the edge of the tool remote from the apex cuts infinitely less material. This results in uneven wear causing the cutting element to become rounded in cross sectional shape, requiring frequent stopping of the cutting operation and redressing of each cutting tool. Because of these problems, square grooves in runways became the standard in the industry despite their drawbacks.

Cutting tools of this type will have many uses other than cutting grooves as described above. One major use can be in routing cracks in any type of paving for the purpose of preparing the crack to receive a sealant for protection against further damage. Other uses can be either straight or rounded champhering of edges of material and forming ornamental concave, convex or other surfaces in a substrate.

With the foregoing in mind, it is the object of the present invention to provide a novel cutting element for material which will cut other than a square groove or form a contoured shape on the surface of the material and which will maintain its original cross sectional shape through extended usage and wear.

It is a further object of the present invention to provide a novel cutting or abrading element in which that portion of the cutting element which must cut or abrade the deepest has the longest dimension in the direction of movement of the cutting element and that portion which cuts the least has the shortest such dimension to provide uniform wear to the surface of the cutting element.

Other objects of the invention will be apparent from the following description.

SUMMARY OF THE INVENTION

A contoured cutting element for cutting a correspondingly contoured groove or shape in a material is carried by a cutting wheel adapted to be rotated and moved across the surface to be shaped. The length of the cutting surface of the element, in the direction of movement of the cutting element is directly proportional to the amount of material that portion of the surface must cut in forming the finished configuration to provide generally uniform wear to the cutting surface of the element over long periods of usage.

DETAILED DESCRIPTION OF THE INVENTION

By the terms contoured cutting element, as used here in is meant a cutting element which will cut or form in any material such as metal, plastic, concrete, asphalt, stone or the like a groove or a cut other than one which is square or rectangular in cross section. Also, by cutting as used herein is meant cutting or abrading away or otherwise removing portions of a substrate by a cutting element which also wears or abrades away during the cutting operation.

Figure 2:
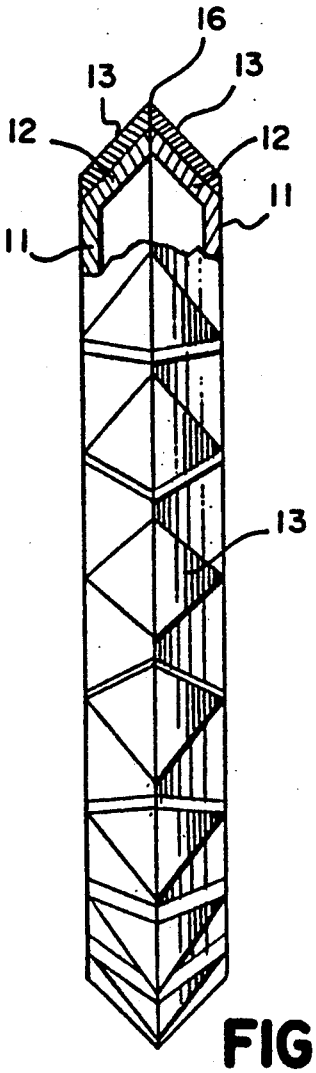
FIG. 2 is a plan view partially in section of the cutting wheel of FIG. 1.
Figure 1:
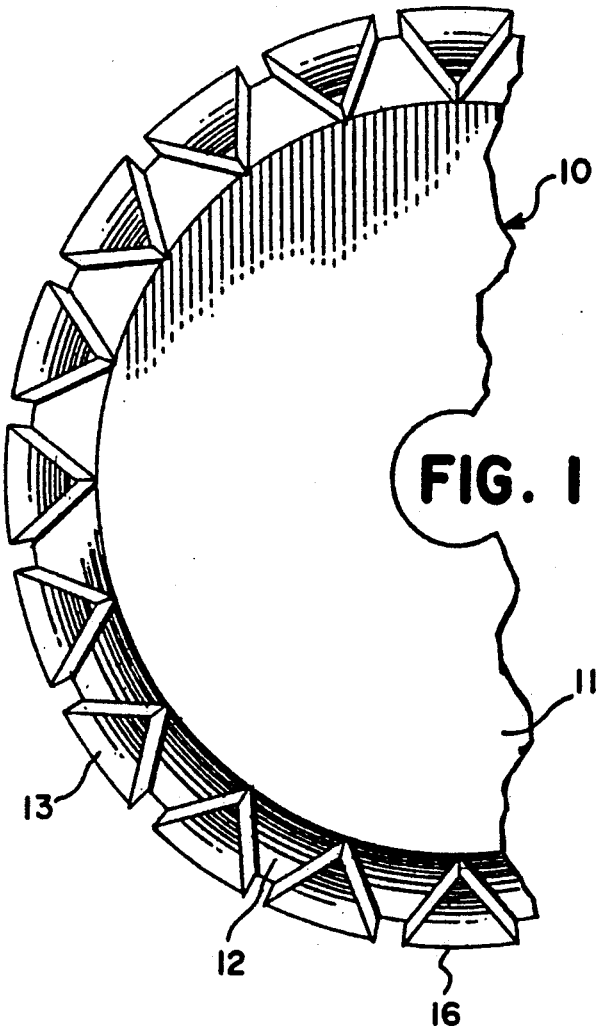
FIG. 1 is a side elevational view of one embodiment of the cutting wheel of the present invention incorporating the contoured cutting tool.
Figure 3:
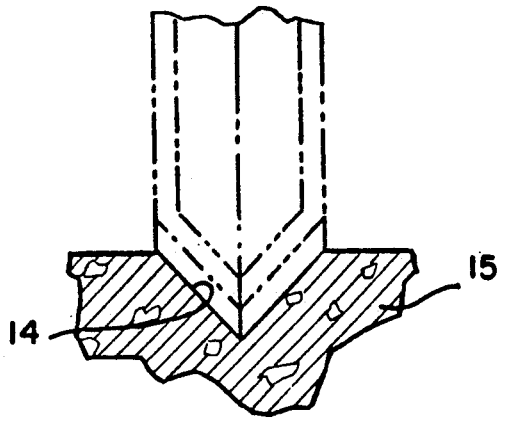
FIG. 3 is a sectional view showing the contour of the groove cut by the cutting element of FIG. 1.

With reference to FIGS. 1 to 3, there is shown a cutting wheel 10 adapted to be mounted by a mandrel or hub (not shown) on a rotatable drive shaft. In practice, when cutting grooves in runways or roads a plurality of such cutting wheels 10 will be mounted in uniform spaced relation on a single driven shaft. The cutting wheels 10 have flat circular side wall segments 11,11 in spaced parallel relation terminating at their outer periphery in angular inwardly directed flanges 12,12. Preferably, these flanges 12,12 are directed inwardly at a 45° angle from the side walls 11,11. In normal use for cutting V-shaped grooves, the two sections of the cutting wheel are mounted on the hub with the flanges in abutting relationship as shown in FIG. 2.

In accordance with the present invention, contoured cutting elements 13 are mounted on the flanges 12,12 at uniform spaced intervals about the periphery of the cutting wheel 10. In this embodiment of the invention, one cutting element 13 is on one flange 12 of the cutting wheel and a corresponding cutting element is on the other flange 12 in alignment with the first cutting element. These cutting elements, when the flanges are abutting are in the relationship, are shown in FIG. 3. The contoured cutting elements 13 are formed from any abrasive material including industrial diamonds. For example, they can compose powdered metals and a suitable abrasive such as industrial diamonds. The cutting elements are secured to the flanges by any conventional fastening means. Silver soldering is one commonly used fastening means to secure cutting elements to a cutting tool.

An important feature of the present invention is the particular configuration of each contoured cutting element. As shown in FIG. 3, the cutting elements 13,13 are designed to cut a V-shaped groove 14 into a substrate 15. The apex 16 of the cutting elements must cut the entire depth of the groove 14. The surface of the cutting elements remote from the apex cut a minimal amount of material from the substrate.

Each longitudinal section of the cutting surface in the direction of movement of the cutting element spaced from the apex cuts less material from the substrate than the immediate preceding section. Thus, the amount of wear at the cutting surface of the cutting element, which has to cut the entire depth of the groove 14 is much greater than that of the remote end of the cutting element which only cuts away a small amount of the substrate. In conventional cutting elements of uniform length in the longitudinal direction of cutting, this would quickly cause the cutting element to wear away or be abraded much more quickly at its apex than at areas remote from its apex. The result of this is that the cutting elements would soon become rounded, or its original contour distourted requiring frequent dressing to be restored to their original shapes.

According to the present invention, this uneven wear is prevented by contouring the cutting element so that the length of the cutting surface of the cutting element, in the direction of movement of the cutting element, is inversely proportional to the amount of material that portion of the cutting element must remove, a quantity equal to the depth of the cut. In the embodiment of FIGS. 1 to 4, to cut a triangular groove 14, the apex of the cutting element, in the longitudinal direction of cutting is the longest portion of the cutting element, and this longitudinal length decreases generally uniformly with the depth of the cut. Thus, as viewed from the side, the cutting elements 13 are triangular in shape.

Figure 4:
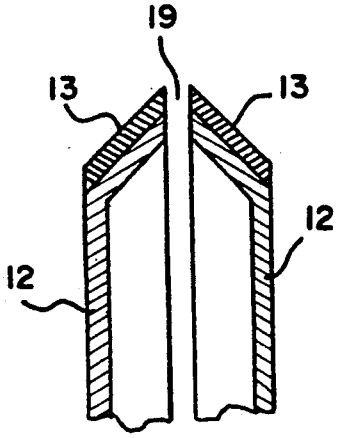
FIG. 4 is a fragmentary sectional view of the cutting wheel of FIGS. 1 and 2 with the side segments of the wheel spaced apart for example to rout a crack in concrete.
Figure 5:
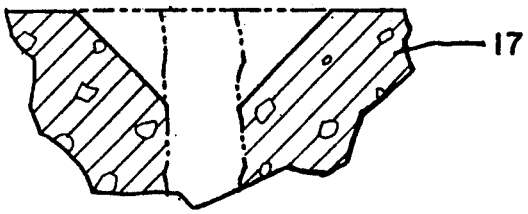
FIG. 5 is a sectional view of the cut or routing in a concrete crack produced by the cutting wheel of FIG. 5.

FIGS. 4 and 5 illustrate a modified use of the cutting wheel of FIGS. 1 and 2 wherein the cutting wheel is used to prepare a crack in concrete pavement 17 for repair. The upper edges of the crack are ground or cut away as indicated at 18 and thereafter a sealing compound, not shown, is deposited in the crack. In this embodiment, the flanges 12,12 of the cutting wheel are spaced apart, providing a gap 19 between the cutting element 13,13. Each cutting element cuts away an angular portion, shown at 18 of the crack, to permit uniform application of the sealing compound. The spacing between the flanges may be varied depending on the width of the crack so that the edges of the crack are cut away for the full depth of the cutting edge of the elements 13.

Figure 7:
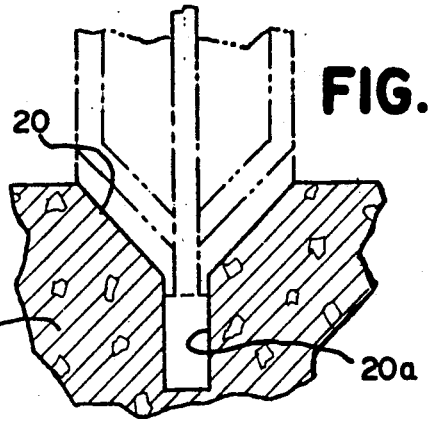
FIG. 7 is a fragmentary sectional view showing the shape of the groove cut by the cutting tool of FIG. 6.
Figure 6:
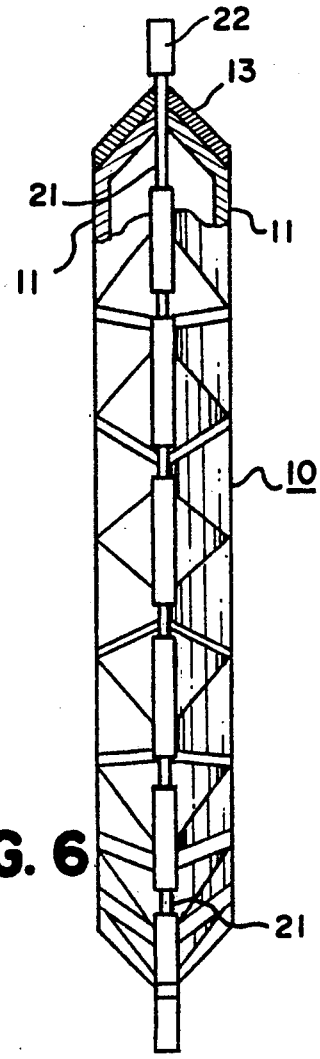
FIG. 6 is a side elevational view of a modified form of cutting wheel of the present invention for cutting a V-shaped groove with a rectangular extension at the base of the groove.

A further embodiment of the invention of FIGS. 1 to 3, inclusive, is illustrated in FIGS. 6 to 7. This embodiment is designed to cut a wider V-shaped groove 20 with a rectangular groove portion **20*a* extending beneath the V-shaped groove 20. In this embodiment, as applied to airport runways and roads, greater water run off is provided while still preventing closing of the edges of the grooves due to landing and braking of aircraft on a runway. Again, as in the embodiment of FIGS. 4 and 5, the flanges 12,12 of the cutting wheel 10 are spaced apart. However, a second cutting disc 21 is provided having cutting elements 22 secured, as previously described, to its periphery. The cutting elements 22 are rectangular in cross-sectional shape and extend beyond the previously described cutting elements 13. This forms the cut 20, 20*a* in the substrate 23, as shown in FIG. 7**.

Figure 9:
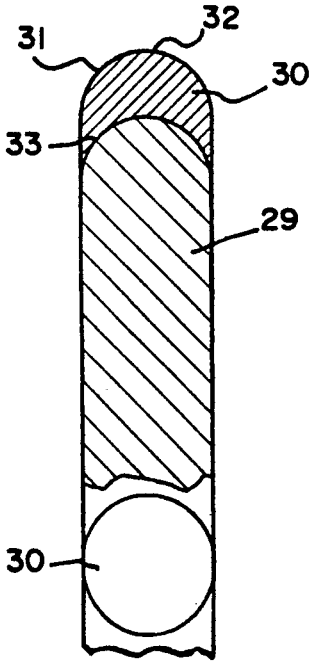
FIG. 9 is a plan view partially in section of the cutting wheel of FIG. 8.
Figure 8:
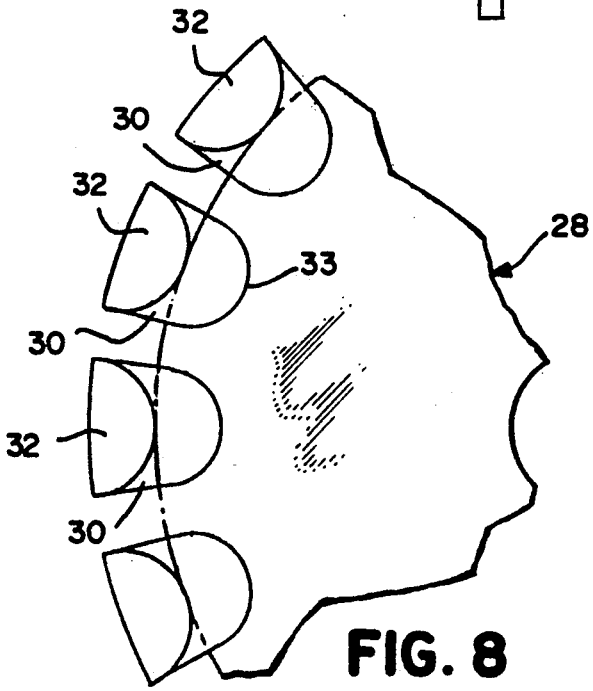
FIG. 8 is a side elevational view of a further modified form of cutting wheel of the present invention for cutting a semi-circular groove.
Figure 10:
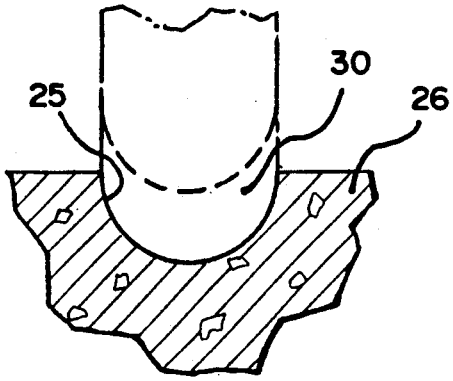
FIG. 10 is a fragmentary sectional view illustrating the groove cut by the cutting wheel of FIG. 8.

FIGS. 8, 9, and 10 illustrate a further embodiment of the present invention designed to cut an arcuate or rounded groove 25 in a substrate 26 while equalizing wear on cutting elements 30. In this embodiment, a circular cutting wheel 28 is provided which can be a single disc 29 with either a rounded or square peripheral edge secured within a matching groove in the cutting elements 30. The cutting elements 30 are secured to the disc 29 as shown, in any desired manner as previously set forth. In this embodiment, the cutting elements 30 have a rounded outer cutting surface 31 with the greatest length in the longitudinal direction of cutting movement at their outer portion 32 and decreasing in length as they approach their inner ends 33. Again, the purpose of this shape is to have uniform wear on the surface of the cutting elements over extended periods of use. Thus, that portion of the cutting surface which must cut the most material has the greatest longitudinal length in the direction of cutting with the length of the cutting surface decreasing generally in inverse relationship to the amount of cutting accomplished.

Figure 11:
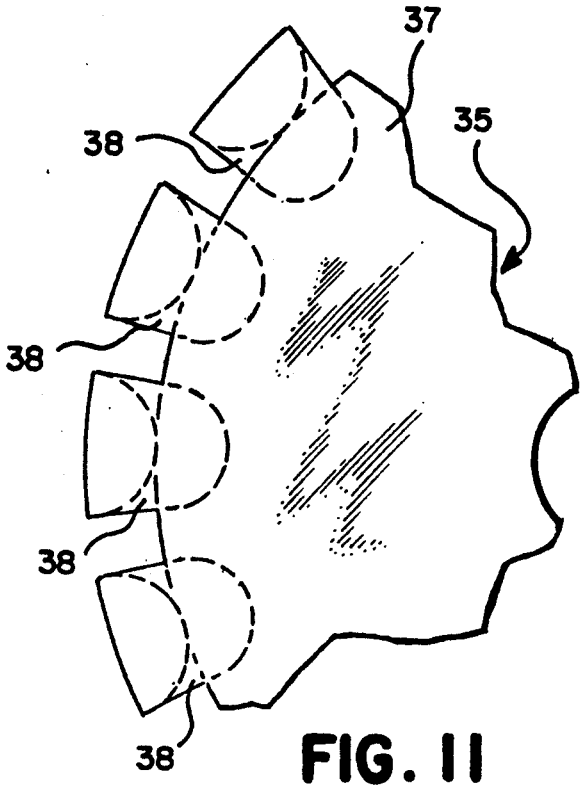
FIG. 11 is a side elevational view of a further embodiment of the present invention.
Figure 12:
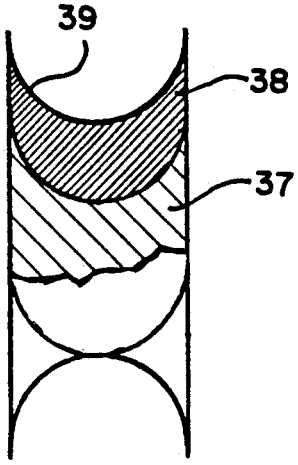
FIG. 12 is a fragmentary plan view partially in section of the cutting wheel of FIG. 11.
Figure 13:
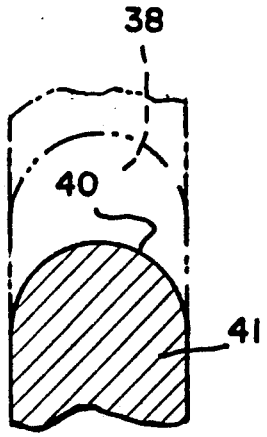
FIG. 13 is a fragmentary sectional view showing the cut made by the cutting tool of FIG. 11.

FIGS. 11, 12, and 13, of the drawings show a still further form of the contoured cutting element of the present invention. In this embodiment, the cutting wheel 35 is similar to that of FIGS. 8 and 9 and also may comprise a single disc. Cutting elements 38 are secured to the disc and spaced equally around its periphery. The cutting elements 38 have a concave cutting surface 39 to cut an ornamental rounded edge 40 on a substrate 41, as shown in FIG. 18. With this configuration, the side edges of the concave cutting surface cuts considerably more material than the midportion. Thus, to equalize wear, the cutting surface 39 is the longest at its side edges and becomes shorter in the longitudinal direction approaching the midportion thereof, as illustrated in FIGS. 11 and 12.

As an alternate to FIGS. 1 and 2 the cutting wheel 10 may be of integral construction instead of a two-piece construction and the contoured cutting elements 13 may also be of unitary construction. This cutting wheel is suitable for cutting V-grooves or chamfering or bevel the edge of an article by using one half of the tool.

While particular embodiments of the present invention have been illustrated and described herein, it is not intended to limit the invention to such a disclosure and changes and modifications may be incorporated therein within the scope of the following claims.

What is claimed is:

1. A contoured cutting element adapted to be secured to a rotatable cutting wheel for cutting a substrate:

said cutting element having a contoured cutting surface with a central longitudinal axis and a longitudinal dimension in the direction of rotation of the cutting wheel and a transverse dimension, said cutting surface adapted to engage and cut said substrate to contour the surface of the substrate with the amount of material cut from the substrate varying transversely of said cutting element;

and said cutting surface decreasing in length longitudinally of said cutting element from the central longitudinal axis thereof in direct proportion to the amount of substrate being cut by that portion of said cutting element in order to provide uniform wear to said cutting element and maintain the contour of said cutting element.

2. A cutting element in accordance with claim 1 wherein the cutting surface is substantially convex in the direction transverse of the cutting element.

3. A cutting element in according with claim 2 wherein said convex cutting surface shape is angular with two flat surfaces joining at an apex, the length of said cutting surface at the apex being the longest with said length decreasing uniformly in a direction away from said apex.

4. A cutting element in accordance with claim 1 wherein the cutting surface is substantially concave in the direction transversely of the cutting element.

5. A cutting element in accordance with claim 1 formed of an abrasive material.

6. A cutting wheel adapted to be mounted on a rotatable shaft for cutting a substrate comprising:

a central circular disc;

a series of similar contoured cutting elements mounted on the periphery of said disc;

each said cutting element having a contoured cutting surface with a central longitudinal axis and a longitudinal dimension in the direction of rotation of the cutting wheel and a transverse dimension, said cutting surface adapted to engage and cut said substrate to contour the surface of the substrate with the amount of material cut from the substrate varying transversely of said cutting element;

said said cutting surface decreasing in length longitudinally of said cutting element from the central longitudinal axis thereof in direct proportion to the amount of substrate being cut by that portion of said cutting element in order to provide uniform wear to said cutting element and maintain the contour of said cutting element.

7. A cutting wheel in accordance with claim 6 wherein said cutting wheel includes a pair of spaced parallel circular discs, a flange at the periphery of each of said discs, and said cutting elements mounted on said flanges.

8. A cutting wheel in accordance with claim 7 wherein said flange is angular in shape with its apex midway between said discs and outwardly beyond the periphery of said discs, and said cutting elements are mounted on said angular flange.

9. A cutting wheel in accordance with claim 7 wherein said flanges are spaced apart from one another and separate cutting elements are mounted on each of said flanges.

10. A cutting wheel in accordance with claim 9 including a third circular disc midway between said pair of spaced parallel discs and between said flanges, and additional cutting elements mounted on the periphery of said third disc.

11. A contoured cutting element adapted to be secured to a rotatable cutting wheel for cutting a substrate comprising:

a contoured cutting surface with a longitudinal dimension in the direction of rotation of the cutting wheel and a transverse dimension;

said cutting surface being adapted to engage and cut said substrate to contour the surface of said substrate with the amount of material cut from said substrate varying transversely of said cutting element;

and said cutting surface is substantially convex in the direction transverse of said cutting element, wherein said cutting surface varies in length longitudinally of said cutting element in direct proportion to the amount of substrate being cut by that portion of said cutting element in order to provide uniform wear to said cutting element and maintain the convex contour of said cutting element.

12. A contoured cutting element adapted to be secured to a rotatable cutting wheel for cutting a substrate comprising:

a contoured cutting surface with a longitudinal dimension in the direction of rotation of the cutting wheel and a transverse dimension;

said cutting surface being adapted to engage and cut said substrate to contour the surface of said substrate with the amount of material cut from said substrate varying transversely of said cutting element;

and said cutting surface is substantially convex in the direction transverse of said cutting element;

wherein the convex cutting shape is angular with two flat surfaces joining at an apex; and wherein said cutting surface varies in length longitudinally of said cutting element in direct proportion to the amount of substrate being cut by that portion of said cutting element in order to provide uniform wear to said cutting element and maintain the convex contour of said cutting element.

* * * * *